United States Patent [19]

Vick et al.

[11] 4,425,841

[45] Jan. 17, 1984

[54] RICE-POLISHING MACHINE

[75] Inventors: Walter Vick, Hamburg; Rolf Suhrbier, Norderstedt, both of Fed. Rep. of Germany

[73] Assignee: F. H. Schule GmbH, Hamburg, Fed. Rep. of Germany

[21] Appl. No.: 389,172

[22] Filed: Jun. 17, 1982

[51] Int. Cl.[3] ..... B02B 3/00; B02B 7/02

[52] U.S. Cl. ..... 99/605; 99/610; 99/619

[58] Field of Search ..... 99/516, 518, 519, 523, 99/524, 528, 529, 600-602, 605-609, 610, 617, 620; 426/482, 483, 507, 511, 461; 241/68, 69, 73, 74, 191

[56] References Cited

U.S. PATENT DOCUMENTS

| | | | |
|---|---|---|---|
| 548,054 | 10/1895 | Hege | 99/524 |
| 1,116,221 | 11/1914 | Beyschlag | 99/606 X |
| 4,155,295 | 5/1979 | Satake | 99/524 X |
| 4,323,006 | 4/1982 | Satake | 99/519 |

*Primary Examiner*—Timothy F. Simone

*Attorney, Agent, or Firm*—Balogh, Osann, Kramer, Dvorak, Genova, & Traub

[57] ABSTRACT

The invention relates to a rice polishing machine including a housing with a shaft which is mounted essentially horizontally therein and which carries a drive coupling member on one end thereof and a polishing rotor with a polishing surface on the opposite end thereof, and also carries a conveyor screw connected coaxially and fixedly to the polishing rotor. The housing is provided with a rice feed orifice at the conveyor screw, and with a rice discharge orifice at the end remote from the conveyor screw. In addition, a screen housing is provided, surrounding the rotor at a short distance therefrom, and a funnel member is provided underneath the screen housing for collecting and discharging the polishing powder. The present invention contemplates an uncomplicated and easily understandable construction which can easily be dismantled and is easily maintained. The polishing rotor and the screen housing are arranged conically with their wider or thicker edges being adjacent to the conveyor screw, and are mounted overhanging on the side of the conveyor screw by means of the bearing tube. The bearing tube surrounds the shaft and is fastened so as to be axially displaceable within a housing cover closing of the housing beyond the rice feed orifice, the internal diameter of the housing in the region of the conveyor screw being greater than the maximum diameter of the rotor, so that the housing cover could be removed from the housing together with the bearing tube, the shaft, the rotor, the conveyor screw and the drive coupling member. The machine requires no fans and can, therefore, be operated with only a mechanical drive without the need for an electrical connection.

5 Claims, 1 Drawing Figure

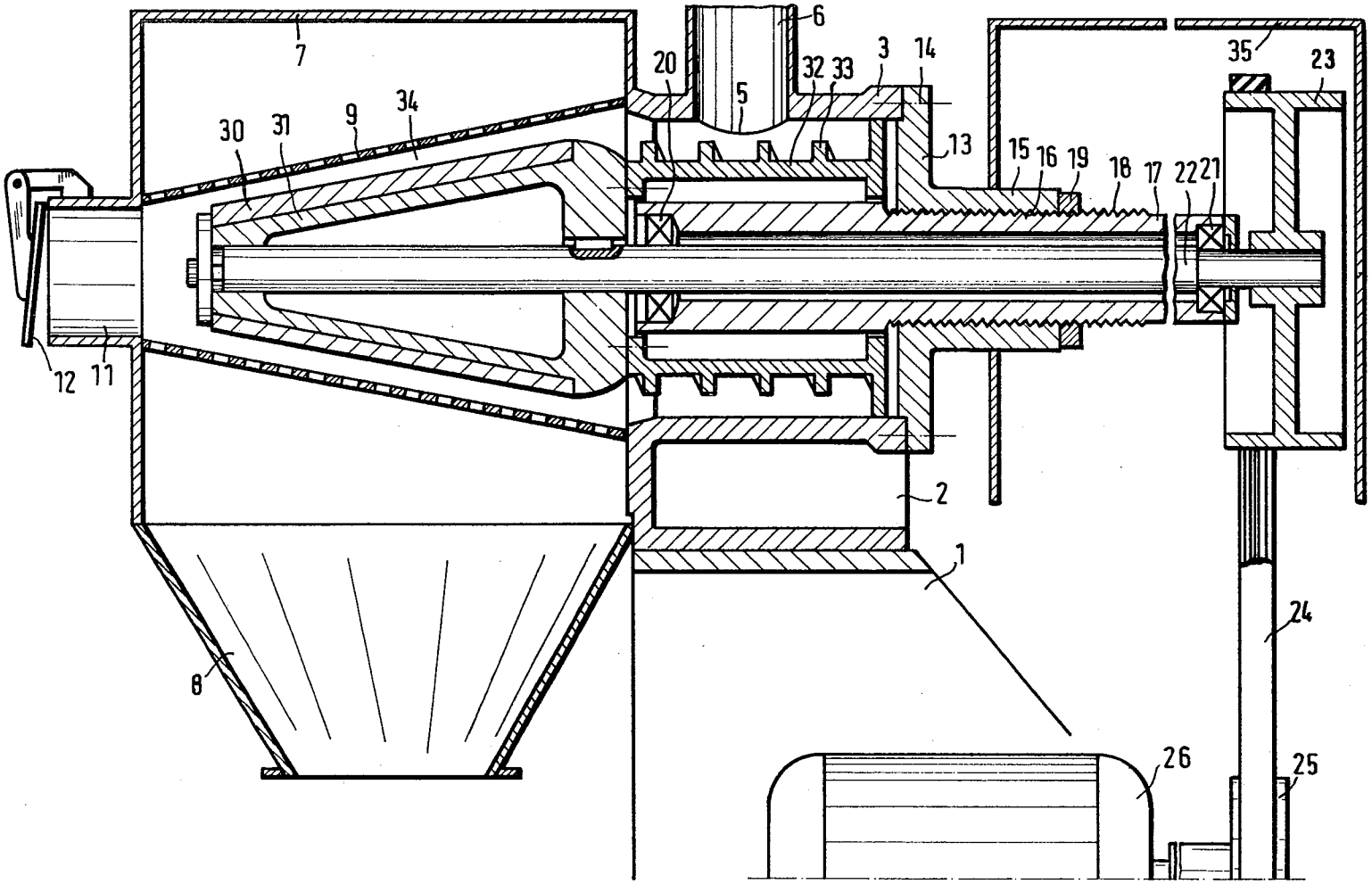
23
35
24
25
21
22
17
18
19
16
15
26
13
14
3
33
32
6
5
20
2
1
34
9
7
31
30
8
11
12

RICE-POLISHING MACHINE

BACKGROUND OF THE INVENTION

1. Field of the Invention

The invention relates generally to a rice polishing machine, and particularly to a horizontal rice polishing machine of the type described hereinafter, the machine including a housing with a shaft mounted essentially horizontally therein, a drive coupling member carried on one end of the shaft, and a polishing-rotor carried on the other opposite end of the shaft, a conveyor screw coaxially and fixedly connected to the polishing-rotor, and a screen housing surrounding the polishing-rotor at a distance so as to form an annular space therebetween for cooperation with the conveyor screw. The housing is also provided with a rice feed orifice at the conveyor screw and with a rice discharge orifice at the edge thereof remote from the conveyor screw. A funnel member is also provided underneath the screen housing for collecting and discharging the polishing powder.

2. Description of the Prior Art

Such machines having a cylindrical polishing rotor are known. The polishing surface of the polishing rotor is formed by an exchangeable casing. This wears away during use and therefore has to be replaced after a certain time. Consequently, the rotor should be easily accessible and easy to remove for maintenance purposes. In known rice-polishing machines, however, the construction of the rotor is complicated, because various parts of the housing have to be removed before the rotor becomes accessible and because the rotor has to be released from its shaft for dismantling. Furthermore, it is desirable if the distance between the polishing rotor surface and the screen housing surrounding the rotor is readjustable. This distance determines, in addition to other parameters, the polishing properties of the machine, so that these change with increasing wear of the rotor. However, the cylindrical rotors used on horizontal rice-polishing machines do not allow such readjustment. It is considered that the outlay on horizontal machines which is necessary to allow readjustability is not justified because these machines generally offer only relatively low polishing quality in comparison with vertical rice-polishing machines, and consequently slight variations in the polishing quality, such as are caused by a varying distance between the rotor surface and the surface of the screen housing, are not important. Conical rotors which can be adjusted axially to set the distance from the screen housing are known only in vertical rice-polishing machines. However, even in the vertical machines, these rotors are very difficult to dismantle because a large number of housing parts must be removed and either the bearings or the rotor have to be released from the shaft. The housing structure of vertical machines is by the very nature of their system substantially more complicated than that of horizontal machines, this being connected with the arrangement of the feed and discharge orifices. Although they generally give a higher polishing quality, nevertheless because of the complications mentioned they are more expensive and present considerable difficulties as regards maintenance, so that horizontal machines are frequently preferred in less technically advanced areas of rice cultivation. Finally, the known rice-polishing machines have the disadvantage that, in addition to a mechanical drive which can be supplied from an electric motor or an internal combustion engine, they also have a fan which generally requires a supply of electrical power. This also can be troublesome for practical application in less technically advanced areas.

SUMMARY OF THE INVENTION

The invention is intended to provide an improved rice-polishing machine, which is of especially simple construction and can be maintained easily by untrained personnel and which requires no electrical power source in addition to a mechanical drive.

The improved horizontal rice polishing machine in accordance with the present invention includes the following novel features:

- a housing cover for closing off the housing integrally formed with a tubular projection which is provided with an internal thread; and
- a bearing tube containing a roller bearing in each of its opposing ends and provided with an external thread. The bearing tube surrounds the shaft and has a portion thereof (with a roller bearing) connected to the tubular projection by means of its external thread engaging with the internal thread of the tubular projection. Due to this construction, the bearing tube is axially displaceable within the housing cover. The polishing rotor and the screen housing are mounted on the conveyor screw by means of the bearing tube. Furthermore, the internal diameter of the housing in the region of the conveyor screw is greater than the maximum diameter of the polishing rotor so that the housing cover can be removed from the machine together with the bearing tube, the shaft, the polishing rotor, the conveyor screw and drive coupling member.

An essential advantage of the machine according to the invention is that the rotor and all the other moving parts which have to be checked and maintained from time to time can be removed easily. In particular, it is sufficient to release the housing cover. After that, the entire rotor together with the rotor shaft and the mounting can be taken out of the machine. The rotor can therefore be changed easily or provided with a new polishing casing. The bearings can easily be inspected and, for example, cleaned.

Although some characterising features are known from vertical rice-polishing machines, nevertheless they do not provide in these the advantages which the invention has recognised when applying these features to horizontal machines. In particular, easy exchangeability could not be achieved or could be achieved only indirectly on a vertical machine, because in such machines the housing is substantially more complicated, by the very nature of their system, than on horizontal machines, in the region of the material feed and the drive.

The invention permits a very reliable and simple mounting of the rotor, because the bearing tube which encloses the bearings together with the shaft can be designed directly to project over a long distance and even into the screw conveyor and, if appropriate, into the rotor. This bearing tube also permits very simple axial adjustment of the rotor and consequently setting of the distance between the rotor surface and the screen housing, since this bearing tube can be retained, so as to be displaceable in a longitudinal direction, in the housing flange mentioned, preferably by means of a thread.

In known machines, a V-belt drive with a V-belt pulley on the motor and with a V-belt pulley on the rotor shaft generally serve for transmitting the rotary movement from the motor to the rotor shaft. In the case of an adjusting displacement of the rotor shaft, such an arrangement would also necessitate a corresponding displacement of the motor. This complication is avoided, according to the invention, by making the belt pulley resting on the rotor shaft, referred to as a drive coupling device or member, smooth, that is to say cylindrical without V-grooves. It can consequently be displaced axially without the V-belts needing to follow it.

The average peripheral speed in rice-polishing machines is, as a general rule, around 13 m/second. When conical polishing rotors are used, this generally presupposes that the space between the rotor surface and the screen housing is not completely filled within the thickness range of the rotor, so that the rice grains can move more or less freely there. If they were kept in a relatively close-packed state there, there would be the danger that, on the one hand, the surface of an individual grain would be polished excessively because it cannot move away from the polishing surface in good time and, on the other hand, too much heat, damaging the grain, would be generated. In contrast to this, the invention selects an unusually low peripheral speed of the rotor, namely between 7 and 11 m/second, preferably between 8 and 10 m/second, which, according to the existing knowledge of milling experts, would necessarily lead to an unsatisfactory polishing result. However, in this way, it achieves the advantage that the grinding space between the rotor surface and the screen housing can be filled practically completely during operation even within the thickness range of the rotor, and this leads to greater utilisation of the machine whilst ensuring, at the same time, a careful treatment of the polishing rotor and of the grain. As a result of this feature, the invention also achieves the further advantage that no fan is required for cooling. Instead, the polishing powder is pressed out through the orifices in the screen housing exclusively as a result of the internal excess pressure and the relative movements and then falls because of the effect of gravity into the discharge funnel located underneath it.

According to a further feature of the invention, the ratio of the length of the polishing rotor to its average diameter is selected above 1.5, especially above 1.8. The invention has recognised, in particular, that as a result of this feature a very careful and yet sufficient polishing effect is achieved. Since an individual grain covers a greater longitudinal distance in relation to the rotor diameter, it is also moved at a higher speed, so that the probability of a multiple and ever-changing contact with the polishing surface of the rotor is greater.

BRIEF DESCRIPTION OF THE DRAWINGS

The invention is explained in more detail below with reference to the drawing which illustrates an advantageous exemplary embodiment of the invention in a FIGURE showing a vertical longitudinal section through the machine.

DESCRIPTION OF THE PREFERRED EMBODIMENT

Fastened to the bracket 1 is a housing part 2 which consists of an essentially cylindrical annular part 3 with a horizontal axis and of a fastening projection 4 made in one piece therewith. The annular part 3 contains at the top the rice feed orifice 5 to which a rice feed tube 6 leads from a filling funnel not shown.

On the left in the drawing, connected fixedly to the annular part 3 is a housing box 7 which continues the interior of the annular part 3 so that the latter is widened axially and which merges at the bottom into a funnel 8 serving for collecting and discharging the grinding powder. The housing box 7 contains, coaxially to the annular part 3, a screen housing 9 which narrows or tapers conically to the left and has a closed circular cross-section and which can be formed by a sheet-metal part containing a plurality of slits extending essentially in an axial direction for the passage of the polishing powder. On the inner side of the screen housing there can be strips extending in a longitudinal direction, which are intended in a known way to retard the movement of the material in a peripheral direction and to promote the turbulence of the material.

The screen housing 9 ends, on the left, coaxially in an outlet 10 forming the rice discharge orifice 11, against which a retaining flap 12 presses with adjustable force under the effect of a spring or a weight, so as to maintain the filling of the grinding space.

The annular part 3 is closed, at its end on the right in the drawing, by a housing cover 13 which is fastened releasably to the annular part 3 by means of screws 14 indicated by dot-and-dash lines and which merges towards the centre in one piece into a tubular part or projection 15 which is coaxial to the annular part 3 and the bore of which has an internal thread 16. Located coaxially in this is a tube 17 which is referred to below as a bearing tube and which has in the central portion of its length an external thread 18 fitting the internal thread 16 with a slight play. By means of the threads 16, 18, interengaging with each other, the bearing tube 17 is retained coaxially in the tubular part 15 of the housing cover 13 so as to be adjustable in a longitudinal direction. Its longitudinal position is fixed by means of a lock nut 19.

The bearing tube 17 contains a roller bearing in each of its two ends a roller (bearing 20 for the left side, 21 for the right side thereof) for mounting a shaft 22 which carries at the right-hand end, outside the bearing tube 17, an externally cylindrical smooth belt pulley 23 which is driven to rotate via V-belts 24 by the V-belt pulley 25 of an electric motor 26, the latter being mounted on the base 1 in a way not shown and being non-adjustable in an axial direction.

The shaft 22 is fixed in the bearing tube 17 in an axial direction. When the latter is adjusted by being rotated in the tubular part 15 in the axial direction of the machine, the belt pulley 23 also follows, without this being prevented by the V-belts 24 which can shift correspondingly on the belt pulley.

At its left-hand end, the shaft 22 carries within the screen housing 9 the polishing rotor 30 so that the latter is connected to it in a rotation-proof manner. This polishing rotor tapers conically to the left parallel to the screen housing 9 and carries on its outer periphery the (polishing) casing 31 consisting of abrasive material. At its right-hand end, the conveyor screw 32 is connected to it coaxially and in a rotation-proof manner, the latter having conveying ribs 33 which convey, to the left in the drawing, the material passing through the rice feed orifice 5 into the annular part 3 of the housing into the conical annular space 34 between the rotor 30, 31 and the screen housing 9. As a result of the conveying effect of the screw 33, the material travels through this annular space up to the rice discharge orifice 11 with a constant circulating and turbulent motion, and in its varying motions it touches the rotor surface and is polished by this. The polishing powder passes through the screen housing 9 and falls into the funnel 8.

A fan is not needed for cooling the material and for discharging the polishing powder.

In an advantageous exemplary embodiment, the maximum external diameter of the polishing casing 31 was 275 mm and the minimum diameter when new was 150 mm. Its length (measured parallel to the axis) was 420 mm. Its drive mechanisms were calculated so that it attained a speed of approximately 575 rpm. Only a very slight counter-pressure by the retaining flap 12 was necessary to maintain a substantially complete filling of the working space between the rotor surface and the screen housing 9. The material left the machine without a break in a well-polished state.

To readjust the rotor, the lock nut 19 is loosened and the bearing tube 17 is screwed to the left, the lock nut then being tightened again. To remove the rotor together with its bearing devices, only the screws 14 are loosened, and the housing cover 13 together with the bearing tube 17, the shaft 22, the rotor 30 and the screw 32 are then taken out of the housing to the right.

A simple protective housing 35 which can easily be removed beforehand can be provided in the drive region.

We claim:

1. In a rice polishing machine of the type including a housing, a shaft mounted essentially horizontally in said housing, a drive coupling member carried by said shaft on one end thereof for connecting the shaft to a drive source, a polishing rotor carried by said shaft on the end thereof opposite to said one end, a conveyor screw coaxially and fixedly connected to the polishing rotor, the housing being provided with a rice feed orifice at the conveyor screw, and with a rice discharge orifice at the edge thereof remote from the conveyor screw, a screen housing surrounding the polishing rotor at a distance therefrom so as to form a space therebetween for cooperation with the conveyor screw, the polishing rotor and said screen housing being conically tapered, parallel to each other, and having the narrow end thereof pointing towards the rice discharge orifice, and funnel means located essentially underneath said screen housing for collecting and discharging polishing powder, the improvement comprising a housing cover for closing off said housing beyond said rice feed orifice, a bearing tube surrounding said shaft and fastened to the housing cover so as to be axially displaceable within the housing cover, the polishing rotor and said screen housing having the wide end thereof, opposite to the narrow end thereof, said polishing rotor being disposed adjacent to the conveyor screw and mounted on a side thereof by means of said bearing tube, the internal diameter of said housing in the region of the conveyor screw being greater than the maximum diameter of the polishing rotor so that the housing cover can be removed from said housing together with the bearing tube, the shaft, the polishing rotor, the conveyor screw and the drive coupling member.

2. An improved rice polishing machine according to claim 1, wherein said bearing tube contains a roller bearing in each of its two opposing ends for mounting of the shaft, a part of said bearing tube with said roller bearing being located within the conveyor screw.

3. An improved rice polishing machine in accordance with claim 2, wherein a part of said bearing tube with said roller bearing is located within the polishing rotor.

4. An improved rice polishing machine according to claim 1, wherein the housing cover has a tubular projection having an internal thread and said bearing tube has an external thread fitting said internal thread of the tubular projection and engaged therewith so that said bearing tube and the tubular projection are connected to each other by means of said internal and external threads.

5. An improved rice polishing machine according to claim 1, further comprising a motor for driving the machine, and V-belts connected to the motor and interacting with said drive coupling member, and wherein said drive coupling member comprises a cylindrical belt pulley carried on the shaft and interacting with said V-belts for driving the shaft.

* * * * *